US006190337B1

(12) United States Patent
Nedwell

(10) Patent No.: US 6,190,337 B1
(45) Date of Patent: Feb. 20, 2001

(54) DISLODGING OR LOOSENING MUCUS IN A PERSON'S LUNGS

(75) Inventor: Jeremy Ross Nedwell, Soberton Heath (GB)

(73) Assignee: Subacoustech Limited, Hampshire (GB)

( * ) Notice: Under 35 U.S.C. 154(b), the term of this patent shall be extended for 0 days.

(21) Appl. No.: 09/111,813

(22) Filed: Jul. 8, 1998

(30) Foreign Application Priority Data

Jul. 14, 1997 (GB) ..... 9714621

(51) Int. Cl.[7] ..... A61H 1/00
(52) U.S. Cl. ..... 601/46; 600/587
(58) Field of Search ..... 601/46, 47–49, 601/55, 68, 69, 84, 86, 154–158, 166, 167, 168, 2, 3, 159–160, 79; 4/491, 541.1, 151.3, 154.5, 541.6; 600/587; 73/1.82, 1.83, 587, 592

(56) References Cited

U.S. PATENT DOCUMENTS

| | | | | |
|---|---|---|---|---|
| 2,904,037 | * | 9/1959 | Cassidy | 601/157 |
| 3,499,437 | * | 3/1970 | Balamuth | 601/2 |
| 3,550,586 | | 12/1970 | Balamuth . | |
| 3,585,991 | * | 6/1971 | Balamuth | 601/157 |
| 3,776,223 | * | 12/1973 | Yeager et al. | 601/157 |
| 3,955,563 | | 5/1976 | Maione . | |
| 4,057,053 | * | 11/1977 | Kunz | 601/27 |
| 4,216,766 | | 8/1980 | Duykers et al. . | |
| 4,339,833 | | 7/1982 | Mandell | 4/542 |
| 5,042,479 | * | 8/1991 | Brotz | 4/491 |
| 5,048,520 | * | 9/1991 | Vago | 601/2 |
| 5,167,226 | | 12/1992 | Laroche et al. . | |
| 5,235,967 | | 8/1993 | Arbisi et al. . | |
| 5,452,594 | * | 9/1995 | Kim et al. | 68/3 SS |

FOREIGN PATENT DOCUMENTS

| | | | | |
|---|---|---|---|---|
| 0154935 A2 | | 9/1985 | (EP) . | |
| 0 651 987 A2 | | 5/1995 | (EP) . | |
| 161464 | * | 3/1964 | (RU) | 601/158 |
| WO87/01584 | | 3/1987 | (WO) . | |

* cited by examiner

*Primary Examiner*—Mickey Yu
*Assistant Examiner*—Justine R. Yu
(74) *Attorney, Agent, or Firm*—Sheridan Ross P.C.

(57) ABSTRACT

An apparatus for dislodging or loosening mucus in a person's lungs, for example of a sufferer of cystic fibrosis, comprises a bath arranged to receive the person and filled with water such that the person's chest is immersed in the water. A vibrator vibrates the liquid so that the vibrations are transmitted to the person's lungs. In use the vibrations are preferably at the pulmonary resonant frequency or Helmholtz resonant frequency of the person's lungs.

9 Claims, 3 Drawing Sheets

DISLODGING OR LOOSENING MUCUS IN A PERSON'S LUNGS

BACKGROUND OF THE INVENTION

1. Field of the Invention

This invention relates to the dislodging or loosening of mucus in a person's lungs.

Cystic fibrosis is an inherited disease which damages vital organs, especially the lungs and pancreas, by clogging them with mucus. Drugs exist which can ameliorate its effects, but physical management of the disease is nevertheless very important.

Mucus is continually produced in the lungs and keeps the airways moist. Particles of dust, dirt or bacteria lodge in the mucus, which is cleared in the healthy lung and swallowed. This process happens all the time and is the way that the lungs keep themselves clear and free of infection.

The mucus produced by cystic fibrosis sufferers contains less water than it should and hence is sticky. As a result, the process of cleaning of the lungs is inefficient or absent leading to build-up of bacteria, dirt and mucus in the lungs. Infection as a result is more likely.

2. Description of the Prior Art

Current physical management relies on using motion of the lungs to dislodge mucus. This can be induced by controlled breathing, and by shaking or clapping of the front, back and/or sides of the chest with the hands. The mechanism by which motion causes clearing of the lungs is not completely understood, but it is probable that it is at least partly because mucus is a thixotropic fluid, that is, one which becomes more fluid when vibrated.

Physical movement of the chest by means of clapping or shaking is likely to be a very inefficient way of causing vibration of the lungs, since the chest wall will resist movement. It is labour intensive and usually requires a partner to administer. In addition, it has to be carefully taught and practised, since the possibility exists of injury if administered too forcefully. This is particularly important in young children and babies who may be unable to give any indication as to its acceptability.

SUMMARY OF THE INVENTION

The present invention has evolved from a realisation that a property of sound in water may be used to stimulate the lungs in a much more efficient and controllable manner. Sound in water interacts with the body much more strongly than sound in air due to the similar physical properties of water and body tissue. Sound in water may easily pass into and out of the body. However, when a body immersed in water is subjected to sound, the lungs become resonant and vibrate strongly. This is because the lungs contain air and can store potential energy when the air is compressed. Also, the water next to the chest acts as a mass, which can score kinetic energy. As a result, a fundamental pulmonary resonance exists, typically at a frequency of about 80 Hz, for the submerged body exposed to sound. At higher frequencies, higher order resonances of the lungs may occur, for instance where one lung is compressing as the other lung is contracting. At high enough frequencies, resonances of other air containing structures of the body may occur. However, no equivalent vibratory resonance occurs in the non-air containing structures of the body, and hence the possibility exists of using this property of sound to vibrate the lung selectively through selection of the correct frequency of the sound, thus enabling relief for sufferers of cystic fibrosis.

Furthermore, it has been found that there additionally exists a Helmholtz resonance of the lungs at a frequency of about 16 Hz in a submerged adult, and correspondingly higher for a child, involving the compressibility of the air in the lungs and the mass of air in the airways and the mass of the water around the chest. At this frequency, a strong resonance of the lungs may be excited, with oscillatory flow of air in the airways, into and out of the lungs occurring along with a large displacement of the lungs and chest wall. This resonance consequently may also may be very beneficial in dislodging mucus.

In accordance with a first aspect of the present invention, there is provided an apparatus for dislodging or loosening mucus in a person's lungs, comprising a bath arranged to receive the person and a liquid such that the person's chest is immersed in the liquid, and means for vibrating the liquid so that the vibrations, which are preferably substantially sinusoidal, are transmitted to the person's lungs.

The vibrating means may preferably be arranged so that it can produce vibrations at the pulmonary resonant frequency of the person's lungs, which may be in the range of 40 to 160 Hz. Alternatively, the vibrating means may preferably be arranged so that it can produce vibrations at the Helmholtz resonant frequency of the person's lungs, which may be about 16 Hz for an adult and correspondingly higher for a child.

In one embodiment, the vibrations have a static frequency. In this case, the apparatus may further include means to adjust the static frequency, for example manually.

In another embodiment, the apparatus further includes means to cause the frequency of the vibrations to be swept over a particular range.

In a further embodiment, the apparatus further includes means to cause the frequency of the vibrations to be random or pseudo-random within a particular frequency range.

In yet another embodiment, the apparatus further includes means for detecting a level of the vibrations transmitted to the person's body, and means for tuning the vibrating means so that the frequency of the vibrations approximates a resonant frequency of the person's body. In this case, the detecting means preferably comprises a liquidproof accelerometer and means for attaching the accelerometer to the person's chest.

The vibrating means is preferably disposed, in use, in front of or behind the person's chest.

The vibrating means may be disposed inside the bath. Alternatively, it may be disposed outside the bath and be arranged to transmit the vibrations to the liquid through a wall of the bath.

The bath may be arranged so that the person can sit up in the bath, with the vibrating means being disposed to one side of the bath. Alternatively, the bath may be arranged so that the person can lie in the bath, with the vibrating means being disposed at the bottom of the bath.

In accordance with a second aspect of the present invention, there is provided a method of dislodging or loosening mucus in a person's lungs, comprising the steps of immersing the person's chest in a liquid, such as water; and vibrating the liquid so that the vibrations are transmitted to the person's lungs.

Preferably, at least some of the vibrations have at least one frequency which is generally equal to a resonant frequency of the person's lungs.

In accordance with a third aspect of the present invention, the apparatus of the first aspect of the invention is used in the method of the second aspect of the invention.

DETAILED DESCRIPTION OF THE PREFERRED EMBODIMENTS

Specific embodiments of the present invention will now be described, purely by way of example, with reference to the accompanying drawings.

Figure 1:
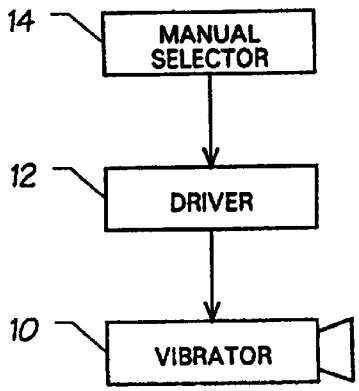
FIGS. 1 to 4 are block diagrams of different arrangements of vibration generating system.

Referring to FIG. 1, a first arrangement of the vibration generating system comprises an electro-mechanical transducer or vibrator 10, a driver circuit 12 for supplying an excitation signal to the vibrator 10 and a manual selector 14 for setting the frequency of the excitation signal in the range of, for example, 40 to 160 Hz.

Figure 2:
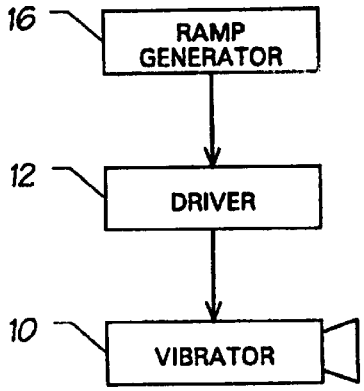

FIG. 2 shows a second arrangement in which the manual selector 14 is replaced with a ramp generator circuit 16 which sweeps the frequency of the excitation signal between a lower limit of, for example, 40 Hz and an upper limit of, for example, 160 Hz. The lower and upper limits may be manually adjustable.

Figure 3:
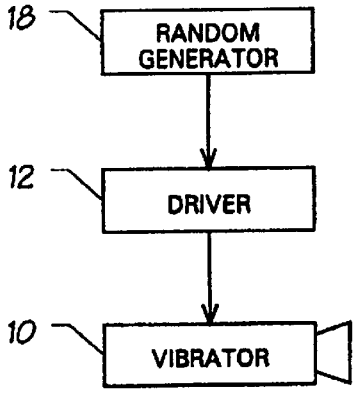

FIG. 3 shows a third arrangement in which the frequency of the excitation signal is determined by a random generator 18 which produces a series of frequencies of random values between a lower limit of, for example, 40 Hz and an upper limit of, for example, 160 Hz. Again, the lower and upper limits may be manually adjustable.

Figure 4:
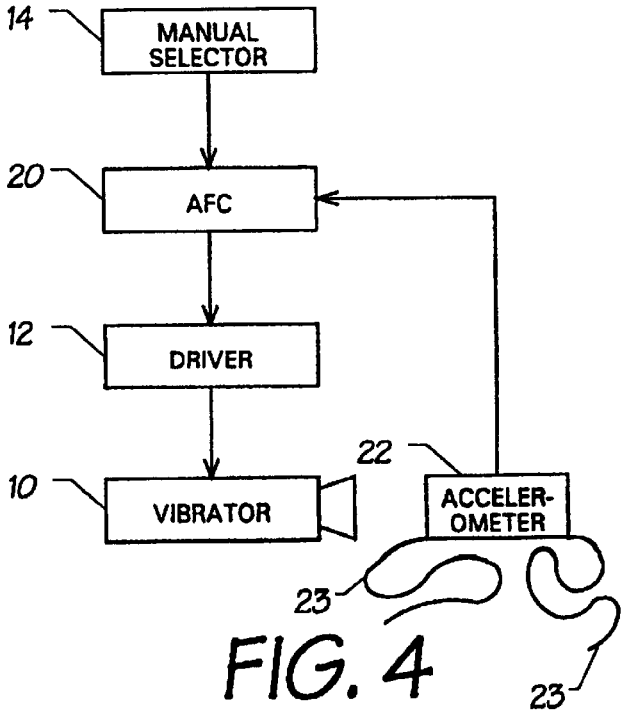

FIG. 4 shows a fourth arrangement in which an automatic frequency control ("AFC") circuit is placed between the manual selector 14 and the driver circuit 12 of FIG. 1. Also, a waterproof accelerometer 22 is attached, for example by straps 23, to the chest of the person and supplies a signal to the AFC circuit 20. The excitation signal initially has a frequency set by the selector 14, but the AFC circuit 20 adjusts the frequency of the excitation signal so as to maximise the level of the signal received from the accelerometer 22.

Figure 5:
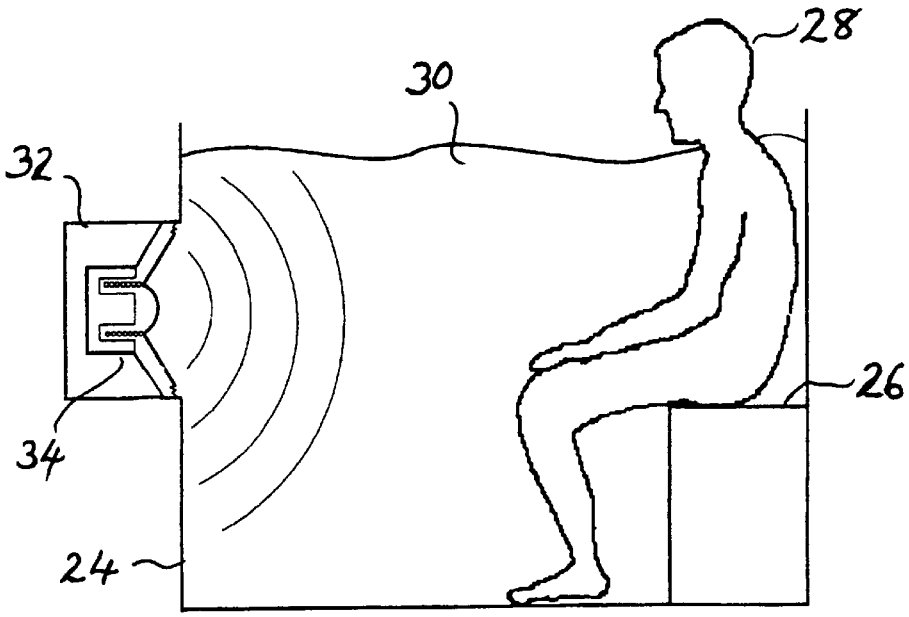
FIGS. 5 to 8 are schematic diagrams of various embodiments of the apparatus.

FIG. 5 shows an embodiment of the apparatus comprising a bath 24 having a seat 26 on which a person 28 sits. The bath 24 contains water 30 up to the neck level of the person 28. The side of the bath in front of the person 28 has a recess 32 containing a waterproof moving-coil loudspeaker 34, which provides the vibrator 10 of any of FIGS. 1 to 4. The axis of the loudspeaker 34 is directed generally towards the chest of the person 28.

Figure 6:
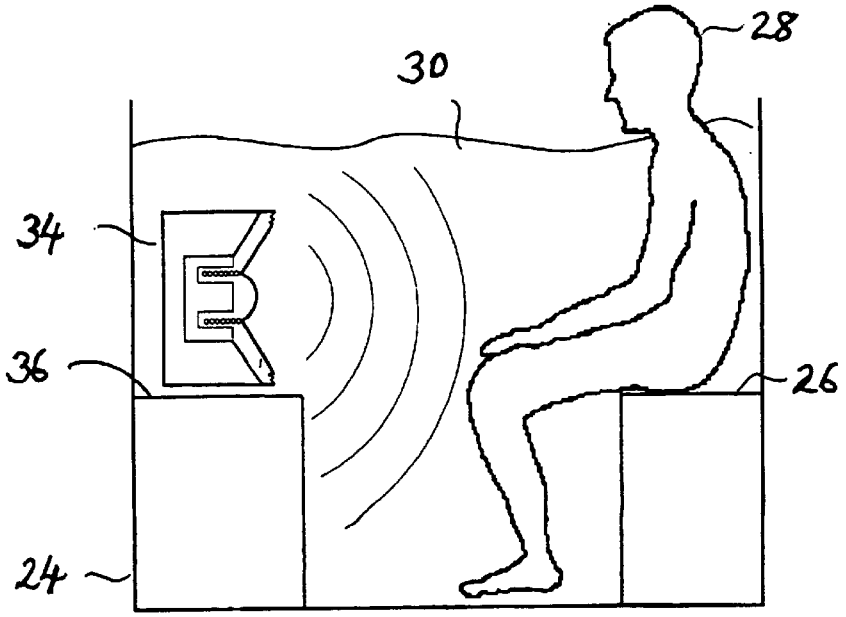

FIG. 6 shows a modification to the embodiment of FIG. 5, in which the loudspeaker 34 is self-contained and is mounted on a shelf 36 in the bath 24.

Figure 7:
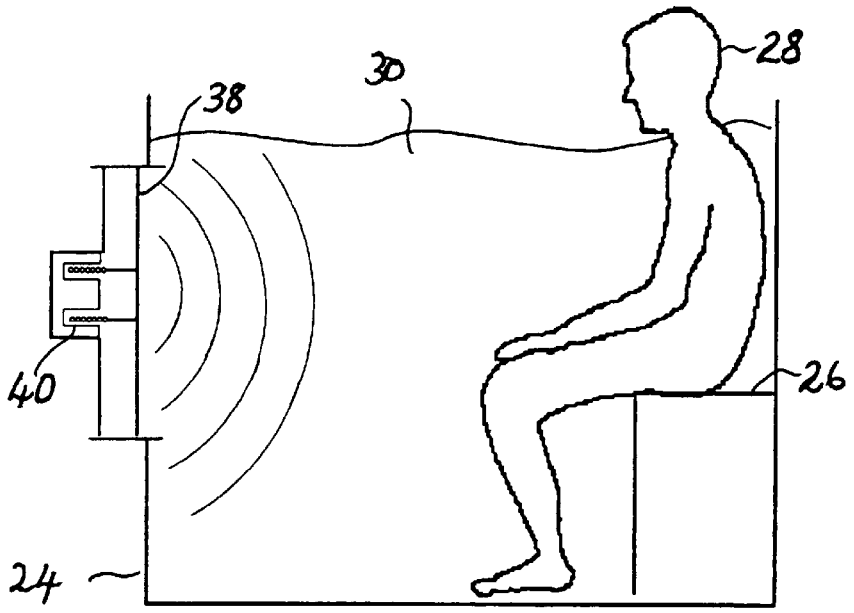

FIG. 7 shows a further modification of the embodiment of FIG. 5 in which a portion 38 of the wall of the bath 24 facing the chest of the person 28 is movable and can be vibrated by a moving-coil arrangement 40 so as to provide the vibrator 10 of any of FIGS. 1 to 4.

Figure 8:
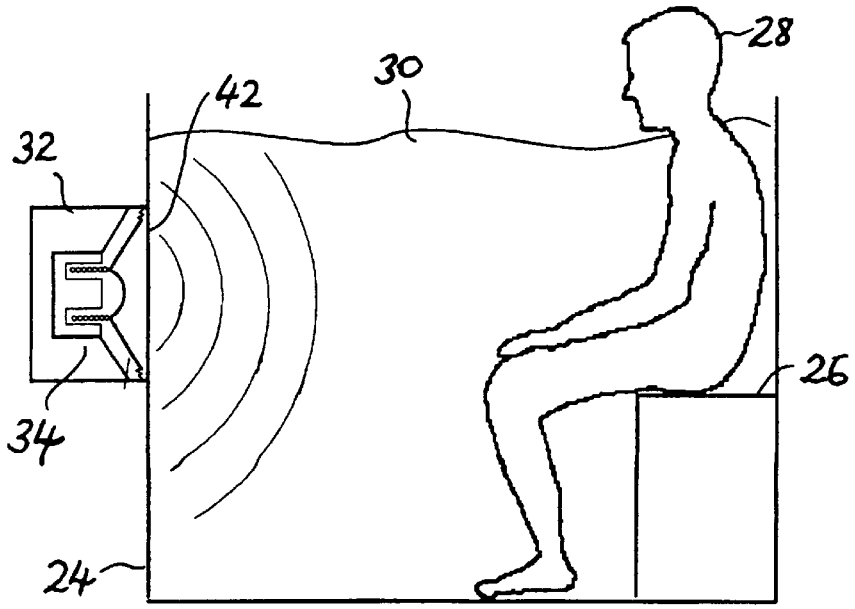

FIG. 8 shows a further modification of the embodiment of FIG. 5, in which a membrane 42, for example of rubber, is disposed in front of the loudspeaker 34 so that the loudspeaker need not be waterproof.

It will be appreciated that many modifications and development may be made to the embodiments described above. For example, the vibrator 10 may be disposed behind, rather than in front of, the person 28. Furthermore, a pair of vibrators 10 may be employed in front of and behind, respectively, the person 28 and may be driven in parallel. Also, the bath 24 may be arranged so that the person lies in the bath, supine or prone, rather than sits in it, and the vibrator 10 may be disposed at the bottom of the bath so as to direct vibrations upwardly to the chest of the person 28. Accordingly, a vibrator 10 may be placed on the bottom of a conventional domestic bath in order to provide the benefits of the invention.

In the embodiments described above, a frequency range of 40 to 160 Hz has been mentioned in order to excite a pulmonary resonance. Alternatively or additionally a frequency of about 16 Hz, or a range from about 16 Hz upwards may be employed in order to excite a Helmholtz resonance of the person's lungs.

In the embodiments described above, the vibrator 10 is provided by a moving-coil device. Other transducers may be used, such as piezoelectric devices, pneumatic devices or rotary motor-driven devices.

It should be noted that the embodiments of the invention have been described purely by way of example, and that many other modifications and developments may be made thereto.

What is claimed is:

1. An apparatus for dislodging or loosening mucus in a person's lungs, comprising:

a bath arranged to receive the person and a liquid such that the person's chest is immersed in tie liquid;

means for vibrating the liquid so that the vibrations are transmitted to the person's lungs;

means for detecting a level of vibrations to produce a detection signal;

means for attaching the detecting means to the person's chest so as to detect a level of the vibrations transmitted to the person's lungs; and means responsive to the detection signal for adjusting the frequency of the vibrations produced by the vibrating means so that the frequency of the vibrations approximates a resonant frequency of the person's lungs.

2. An apparatus as claimed in claim 1, wherein the adjusting means is arranged to adjust the frequency of the vibrations produced by the vibrating means to such a resonant frequency in the range of 40 to 160 Hz.

3. An apparatus as claimed in claim 1, wherein the vibrations are substantially sinusoidal.

4. An apparatus, as claimed in claim 1, wherein the detecting means comprises a liquidproof accelerometer.

5. An apparatus as claimed in claim 1, wherein the vibrating means is disposed, in use, in front of or behind the person's chest.

6. An apparatus as claimed in claim 1, wherein the vibrating means is disposed inside the bath.

7. An apparatus as claimed in claim 1, wherein the vibrating means is disposed outside the bath and is arranged to transmit the vibrations to the liquid through a wall of the bath.

8. An apparatus as claimed in claim 1, wherein the bath is arranged so that the person can sit up in the bath, and the vibrating means is disposed to one side of the bath.

9. An apparatus as claimed in claim 1, wherein the bath is arranged so that the person can lie in the bath, and the vibrating means is disposed at the bottom of the bath.

* * * * *